United States Patent [19]

Tricarico

[11] Patent Number: 4,660,349

[45] Date of Patent: Apr. 28, 1987

[54] METHOD OF ERECTING A BUILDING USING PRECONSTRUCTED MODULAR UNITS

[76] Inventor: Rocco V. Tricarico, 10721 Greene Dr., Lorton, Va. 22079

[21] Appl. No.: 633,280

[22] Filed: Jul. 23, 1984

[51] Int. Cl.[4] ..... E04B 1/00

[52] U.S. Cl. ..... 52/745; 52/79.11

[58] Field of Search ..... 52/745, 79, 234, 185, 52/236.3, 236.5, 79.2, 79.11, 236.8, 79.14, 747, 741

[56] References Cited

U.S. PATENT DOCUMENTS

| | | | |
|---|---|---|---|
| 3,751,864 | 8/1973 | Berger et al. | 52/79.11 |
| 3,812,637 | 5/1974 | Yang et al. | 52/745 |
| 3,831,327 | 8/1974 | McCrillis et al. | 52/745 X |
| 4,003,182 | 1/1977 | Wokas | 52/745 |
| 4,096,675 | 6/1978 | Howard et al. | 52/79.1 |

FOREIGN PATENT DOCUMENTS

| | | | |
|---|---|---|---|
| 626263 | 8/1961 | Canada | 52/745 |

*Primary Examiner*—Carl D. Friedman
*Assistant Examiner*—Naoho N. Slack
*Attorney, Agent, or Firm*—Watson, Cole, Grindle & Watson

[57] ABSTRACT

A method of erecting a building in which preformed modular units are utilized to support the next upwardly adjacent floor of the building. In one embodiment the modular unit is constructed of light-gauge framing materials that provide a temporary support for the poured-in-place concrete used to form the floor. After the concrete has hardened, the supporting function of the modular unit is no longer required.

7 Claims, 5 Drawing Figures

METHOD OF ERECTING A BUILDING USING PRECONSTRUCTED MODULAR UNITS

BACKGROUND OF THE INVENTION

1. Field of the Invention

This application relates in general to the building trades and to a method of erecting a building that employs concrete in its construction. More specifically, it relates to such a method that makes particular use of modular units preconstructed to serve specific utility.

2. The Prior Art

Prior to the present invention, the construction of multiple family dwellings and office buildings, where those structures employ concrete as a basic building material, was fairly standard. A concrete floor was poured. Then, vertical columns were erected using boxes as forms to receive the concrete for the next level of columns. Concrete was poured in place into the boxes until the required number of columns had been obtained. Thereafter, a forest of wood or metal posts and beams was constructed, and that forest was covered with plywood at the designated level of the next floor. Then, with the plywood, shoring and forming in place and supported by the floor below, the next designated floor of the building was poured in place. After the concrete floor had hardened, the beams, braces, posts and plywood were removed and the concrete provided its own support, assisted by the vertical concrete columns already in place. To form the next floor of the building, boxes were again assembled as forms for the vertical columns of concrete, and once more the vertical columns were poured in place with concrete and the entire procedure repeated.

Such a building method, while satisfactory, is obviously expensive and causes a great deal of effort and time to be expended in constructing the forest of posts and beams that are to be covered with plywood. After the concrete has hardened the entire assembly must be dismantled, only to be assembled again at the level of the next designated upper floor. As a consequence, there has long been a need for a method of erecting a building that does not require the extensive assembly and later elimination of a complex forest of beams and posts. Modular units appear to be a reasonable alternative, and precast concrete has been utilized for the flooring rather than poured-in-place concrete. Modular units lend themselves particularly well to construction of high rise buildings where certain units or rooms of the building will be duplicated after the building has been erected and will not be subject to change, such as bathrooms, kitchens and other utilitarian spaces.

Exemplary of units that will be duplicated almost identically throughout an office building and, therefore, will lend themselves to preconstructed modular treatment, are toilets. Normally toilets will all have the same fixtures, and will be of the same size. Consequently, it would be economical to manufacture such units in their entirety away from the site of the construction and to order specific materials from which the modular units will be constructed in large quantities and with attendant savings. After economic assembly of toilets away from the construction site, the modular units are transported to the construction site and, after each floor of the building is completed, the modular units are then seated at their respective positions.

Preconstruction of portions of a building, which can reduce forming and shoring costs and time, apply to precast floors for the building. Also, while there may be some savings effected in using the precast floors, the savings would be increased through the use of preconstructed modular toilets or kitchens. Since field assembling a kitchen and bathroom requires great detail work, time and cost savings can be realized by using preconstructed modular bathrooms, kitchens, and even utility rooms. In such a modular unit, the walls can be painted, cabinets and fixtures installed, and entire plumbing and electrical systems put in place, as well as mechanical duct work and exhaust systems. Even sprinkler systems can be installed, so that the entire kitchen will be ready for use, with or without a floor covering, and it can be transported to the building site and directly put in place. Until my present invention, however, the use of preconstructed modular units has not had the additional advantage of actually simplifying the erection of the building, itself.

It is, therefore, an important object of the present invention to provide a method of erecting a building employing a plurality of preconstructed modular units, in which the modular units will assist in and simplify the construction of the building.

More specifically, it is an object of the present invention to provide such a method in which the preconstructed modular units can furnish support for either a poured-in-place concrete floor or a precast concrete floor, either of which is to be installed at the next upper floor that is to be laid at the approximate height of the top wall of the modular unit.

SUMMARY OF THE INVENTION

The aforesaid objects, features and advantages have been met by the present invention, in which a preconstructed modular unit is located on a floor of a building before the next upper floor has been put in place. As so installed, the modular unit, be it bathroom, kitchen or utility room, may be constructed so as to have a load bearing capability for only a relatively short period of time. In this manner the top of the modular unit can function in the general manner of a plywood form supported by a forest of beams and posts. When the next upper floor is being constructed, particularly from poured-in-place concrete, that concrete can be poured over and in contact with the top wall of the modular unit. The top and side walls of the unit will have to function to support the wet concrete after it has been poured and before it has hardened. After the concrete has hardened, it will be self-supporting and the load bearing capability of the modular unit will no longer be required.

If, on the other hand, the modular unit is constructed with greater load bearing capability, precast concrete flooring can be laid in contact with the top wall of the unit. As a consequence, the next upper floor will be supported in part by the modular unit and that floor may then contain another modular unit, which will again furnish either a permanent support function, or will temporarily support a poured-in-place concrete floor above it. In this manner the economies of utilizing preconstructed modular units will be preserved and, in addition, such units will also function as a construction unit to support either poured-in-place concrete or precast concrete, either of which forms the floor of the next upper level of the building.

These and other objects, features and advantages of the present invention will become more apparent when considered in conjunction with several preferred embodiments of my invention. Those embodiments are described in conjunction with the accompanying drawings, which form a part hereof, and which are included by way of illustration of the invention and not in limitation thereof.

Figure 1:
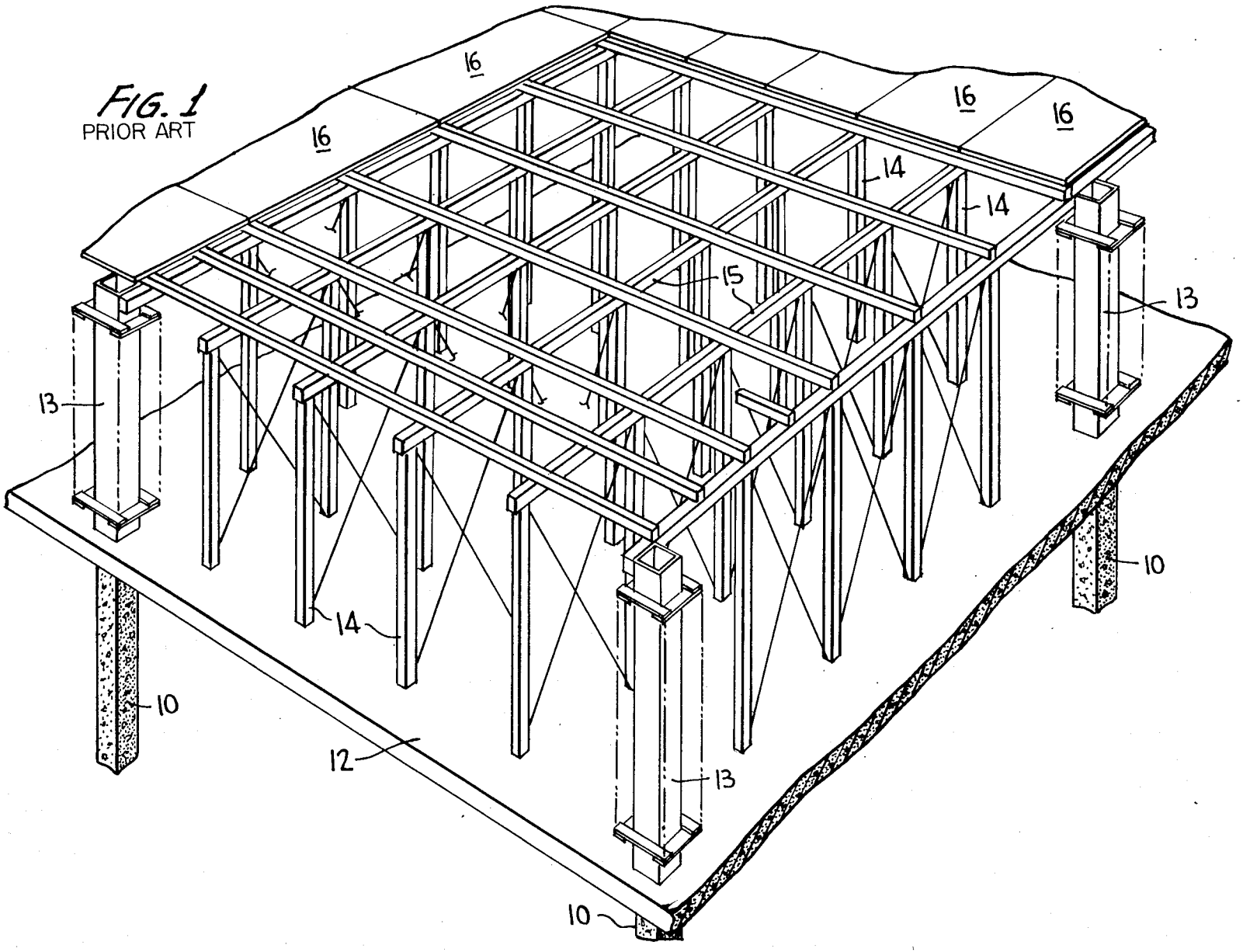
FIG. 1 PRIOR ART
FIG. 1 is a perspective view of a prior art structure, without a modular unit in place in accordance with the present invention.
Figure 2:
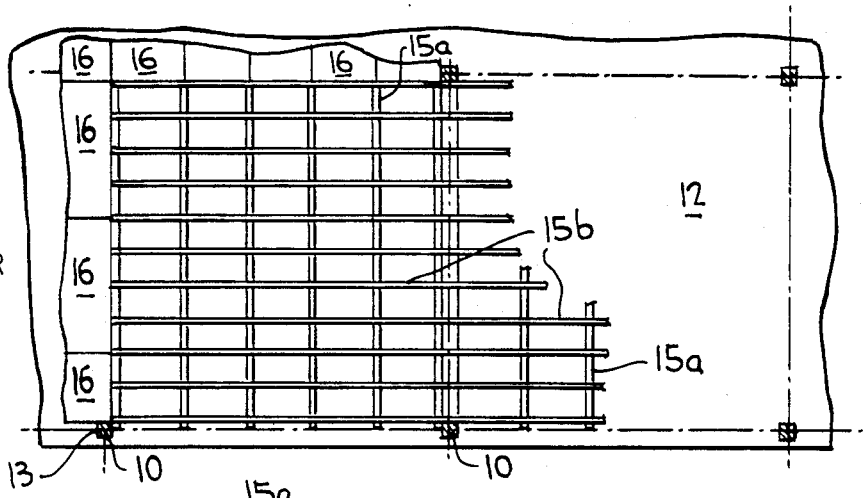
FIG. 2 PRIOR ART
FIG. 2 is a diagrammatic plan view of the prior art structure.

Referring now to the drawings, and particularly to FIGS. 1 and 2 thereof, what is illustrated therein is a normal mode of constructing a floor of a multi-floor building. In the view as seen in FIG. 1, concrete columns 10 have previously been cast and hardened to support lower floor 12. Boxes, that is, plywood forms for the next group of vertical columns, are concentric with the lower floor concrete columns 10, such boxes being identified by reference numeral 13. After concrete columns have been poured in place in boxes 13, they are interconnected by a forest of posts 14 and beams 15, which will serve as support for plywood forms 16 that are laid atop and fastened to the beams 15 in a conventional manner. As so laid in abutting and contiguous relationship, the plywood forms will, together with shoring, constitute a base on which a layer of concrete may conventionally be poured in place. After hardening, such poured-in-place concrete will become the next floor of the building, being positioned generally at the level of the horizontal beams 15 as shown in FIG. 1.

Referring to FIG. 2, what is shown here in diagrammatic form is effectively a top plan view of FIG. 1. The boxes that act as forms for concrete to be poured in place are identified by reference numeral 13. Beams 15*a* and 15*b* extend across both dimensions of the space between concrete columns 10, and the vertically extending posts 14 are obscured by beams 15 in the top plan view. Again, this is the prior art, normal manner of pouring concrete in place. If precast concrete is utilized, it is possible to insert slabs of precast concrete between adjoining vertically extending columns so that the slabs will rest on the columns and be supported by them alone. In this case, the size of the horizontally laid, precast concrete slabs is determined by the spacing of the vertical columns 10.

Figure 3:
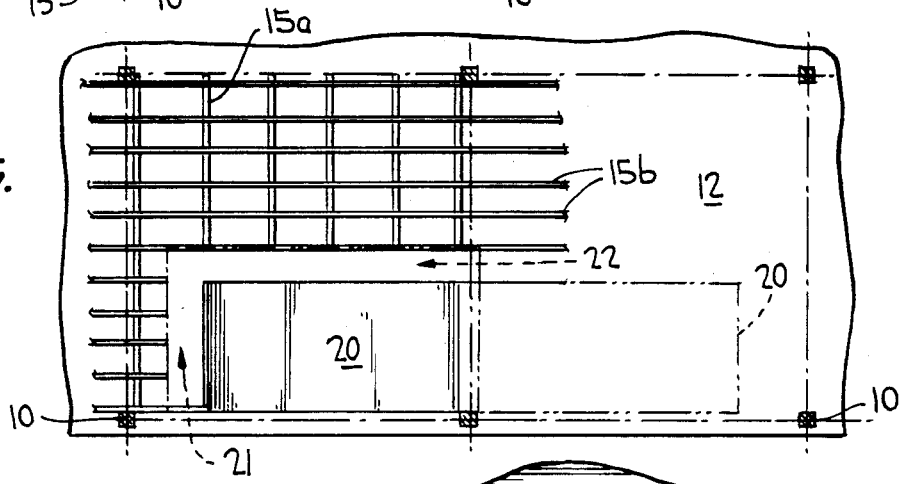
FIG. 3 is a diagrammatic plan view similar to that of FIG. 2, but showing a modular unit in place according to the present invention.

Referring now to FIG. 3, what is there illustrated diagrammatically is what is shown in FIG. 2, except that a modular unit has been set in place according to the present invention prior to pouring in place the concrete for the next floor of the building. Seen in FIG. 3 is the top wall of such modular unit 20, as well as the beams 15*a* and 15*b* that extend in a plane substantially at the level of the top wall of the modular unit 20, and which extend both longitudinally and transversely in that plane.

It should be noted in FIG. 3 that the beams are offset laterally from the pheriphery of the top wall of the modular unit 20 so that spaces indicated by arrows 21 and 22, respectively, are formed between the nearest of the horizontally extending beams 15*a* and 15*b*, and the periphery of the modular unit 20. In actual practice the spacings 21 and 22 will be somewhat less than four feet. Plywood sheets, such as those indicated by numeral 16, which are four feet by eight feet, are employed to provide a form in which concrete may be poured. In this manner the plywood can rest on the next adjacent beams 15*a* and 15*b* as well as the top wall of the modular unit 20, and thus have support along all four sides of the plywood sheet. The plywood sheet will be fully supported, and a continuous form is provided by the plywood sheets and the top of the modular unit 20 into which concrete can be poured and then permitted to harden.

Figure 4:
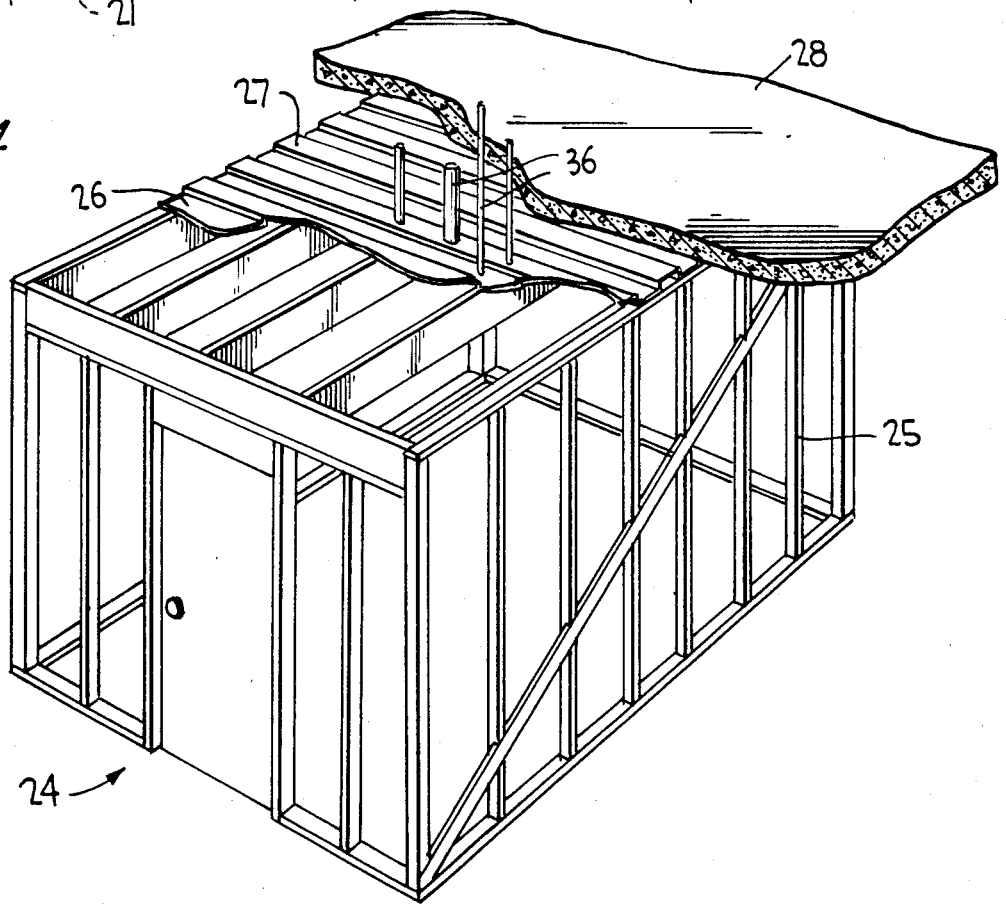
FIG. 4 is an illustration, in perspective and partially broken away, of one modular unit utilized in the present invention.

A specific example of a modular unit, without showing interior details thereof, is illustrated in FIGS. 4. and 5. In FIG. 4, the modular unit 24 disclosed is one which is not intended to be permanently supportive of a superimposed structure, in most instances, the floor of the next upper level or the roof of the building. Thus, the modular unit is simply framed out with light gauge steel, with side wall framing 25, a top indicated generally by numeral 26, and an upwardly extending surface of the top to which a corrugated sheet 27 has been attached. The concrete that has preferably been poured in place, or which may be in the form of a precast slab, is shown at 28. Corrugations 27 are revealed as the slab 28 is broken away.

Figure 5:
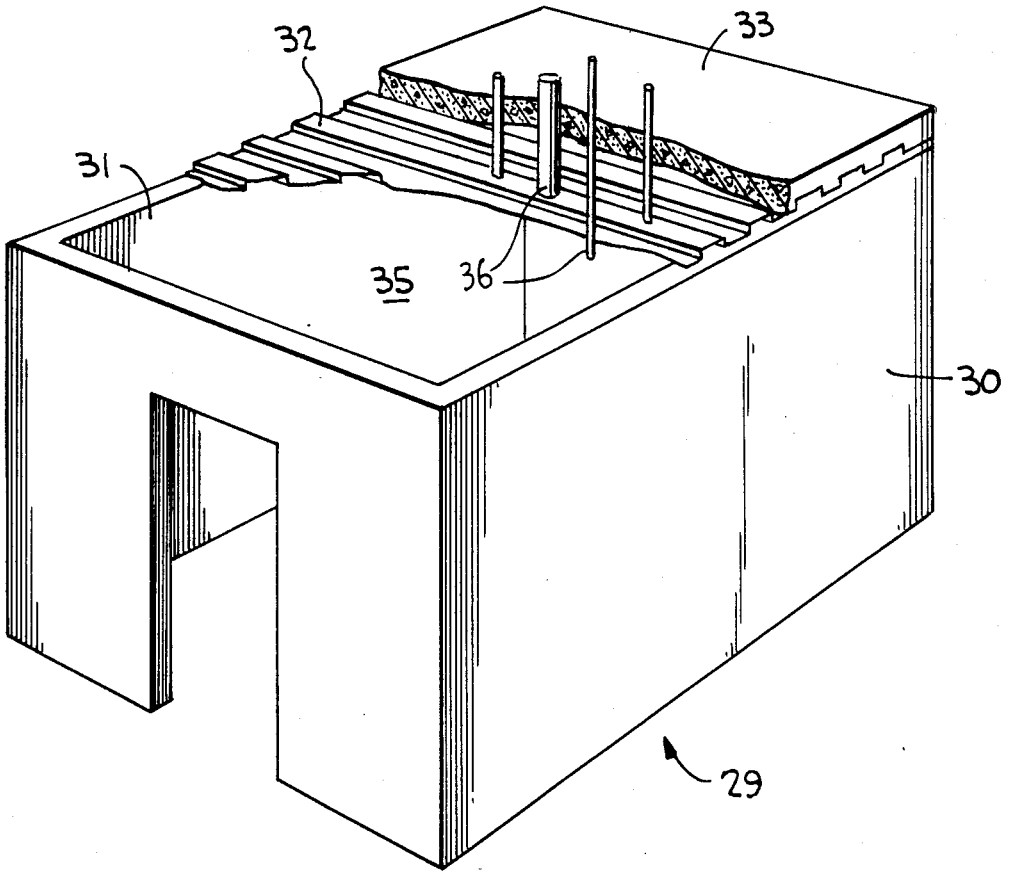
FIG. 5 is a perspective view, partly broken away, of another modular unit utilized in the present invention.

FIG. 5 illustrates an alternate construction of a preconstructed modular unit 29, which is formed from precast concrete. Thus, side walls 30 of the FIG. 5 module embodiment are formed of precast concrete which has significant load-bearing capability. Such a module 29 is capable of providing support so that, in the construction of a building, vertical concrete columns may be eliminated at least in part, and the concrete modular units 29 can take the place of such columns, where desired. In this embodiment of the invention, the preconstructed concrete modular unit 29 has a top indicated generally at 31, which may be formed with upwardly facing surface 35 on which a corrugated sheet 32 is placed to serve as means to hold the concrete if it is poured in place to form the next upwardly extending floor 33 the top can also be formed of precast concrete.

As illustrated in both FIGS. 4 and 5 of the drawings, use of modular units according to the present invention provides a further feature and advantage where conduits for electrical, plumbing, and other utilities are incorporated in the unit. As shown in both figures, conduits 36 are preferably embodied in the top of the module and project upwardly therefrom. When concrete is poured in place, it is poured around the conduits 36 without disturbing the connections therewithin. This feature eliminates the time consuming and expensive task of locating and providing holes for continuous vertical piping through the building.

In the present invention it is basic that a modular unit, whether intended to be temporarily load-bearing, as in that illustrated in FIG. 4, or permanently load-bearing, as the unit illustrated in FIG. 5, serves to act as a form for liquid concrete if it is poured in place to form the next upper floor of the building. In such case, either module type, i.e., either of the units illustrated in FIGS. 4 or 5, can be utilized for its supporting function. However, if a precast concrete slab is to be utilized for the next upper floor of the building, then a modular unit such as that disclosed in FIG. 5 is preferred, because it will provide permanent rather than merely temporary support for the slab. In either case, there will be a significant reduction in the cost of providing certain adaptable rooms in the building, and those rooms will serve a support function that has not previously been accomplished. That function will either assist in permanently supporting precast concrete slabs or may be simply a temporary support for poured-in-place concrete prior to the hardening thereof.

While the present invention has been described in conjunction with preferred embodiments thereof, it will be apparent that the invention may take many forms and that alterations, modifications and additions may be made thereto without departing from the purview of the invention. My invention, therefore, is to be measured only by the scope of the following, appended claims, including equivalents thereof.

I claim:

1. A method of constructing a building employing one or more preconstructed modular units each of which constitutes a room of the building after the completion thereof, comprising (a) providing a floor for one level of the building during construction;

(b) locating on said floor a preconstructed modular unit constructed of light-gauge framing materials unsuitable for permanent floor support capability, said unit having bottom and top walls positioned so that the top wall of said unit is generally at the designated level for the next upper floor of the building to be constructed;

(c) erecting a temporary shoring and forming system to support the weight of concrete to be poured in place to form said next upper floor, said system being erected in areas of said designated level remote from said top wall of said modular unit but being supported in part by said wall;

(d) at the same time pouring in place concrete over the top wall of said modular unit and over said system to form said next upper floor utilizing the top wall of said modular unit to support part of the weight of the poured-in-place concrete prior to the hardening thereof, with the shoring and forming system supporting said concrete at said remote locations;

(e) permitting said poured-in-place concrete to harden and thereby free said modular unit from the majority of its support function, and (f) removing said temporary shoring and forming system to form a continuous slab of concrete floor over said modular unit and said floor areas remote therefrom.

2. A method of constructing a building as claimed in claim 1, in which said top wall of said unit has an upwardly facing surface specifically adapted to retain concrete poured in place thereon, thereby eliminating the need for plywood forming and shoring at the area of said upwardly facing surface.

3. A method of constructing a building as claimed in claim 2, in which said upwardly facing surface of said top wall is corrugated.

4. A method of constructing a building as claimed in claim 2, in which said upwardly facing surface of said top wall holds a deformed metal sheet adapted to retain concrete poured thereon.

5. A method of constructing a building as claimed in claim 2, in which said upwardly facing surface of said top wall holds a corrugated metal sheet adapted to retain concrete poured therein.

6. A method of constructing a building as claimed in claim 1, in which said forming and shoring system is spaced laterally from said top wall of said modular unit by a distance approximating a linear dimension of a plywood sheet utilized in said system to support poured-in-place concrete.

7. A method of constructing a building as claimed in claim 1, in which said modular unit has at least one utility conduit extending outwardly from its top and said poured-in-place concrete extends around but does not block said conduit.

* * * * *